US009669614B2

(12) United States Patent
Ludin

(10) Patent No.: US 9,669,614 B2
(45) Date of Patent: Jun. 6, 2017

(54) PRINTING UNIT

(71) Applicant: CONPRINTA GmbH & Co. KG, Goettingen (DE)

(72) Inventor: Guntmar-Michael Ludin, Kippenheim (DE)

(73) Assignee: Conprinta GmbH & Co. KG, Goettingen (DE)

( * ) Notice: Subject to any disclaimer, the term of this patent is extended or adjusted under 35 U.S.C. 154(b) by 0 days.

(21) Appl. No.: 14/900,374

(22) PCT Filed: Jun. 10, 2014

(86) PCT No.: PCT/EP2014/001567
§ 371 (c)(1),
(2) Date: Dec. 21, 2015

(87) PCT Pub. No.: WO2014/206530
PCT Pub. Date: Dec. 31, 2014

(65) Prior Publication Data

US 2016/0159071 A1 Jun. 9, 2016

(30) Foreign Application Priority Data

Jun. 28, 2013 (EP) ..... 13003292

(51) Int. Cl.
*B41F 7/02* (2006.01)
*B41F 5/24* (2006.01)
*B41F 13/14* (2006.01)
*B41F 13/34* (2006.01)

(52) U.S. Cl.
CPC ..... *B41F 5/24* (2013.01); *B41F 13/14* (2013.01); *B41F 13/34* (2013.01)

(58) Field of Classification Search
CPC ..... B41F 5/24
USPC ..... 101/217
See application file for complete search history.

(56) References Cited

U.S. PATENT DOCUMENTS 3,559,572 A * 2/1971 Hackley ..... B41F 31/20 101/350.1
4,782,753 A * 11/1988 Bolza-Schunemann B41F 31/00 101/217
8,578,850 B2 * 11/2013 Westhof ..... B41F 5/24 101/185
9,132,622 B2 * 9/2015 Ramakrishnan ..... B41F 5/24
2005/0016406 A1 * 1/2005 Veismann ..... B41F 5/24 101/486
2005/0199144 A1 * 9/2005 Riedel ..... B41F 13/187 101/153

(Continued)

FOREIGN PATENT DOCUMENTS

DE 10 2008 044 154 A1 6/2010
JP WO 9734187 A1 * 9/1997 ..... B41F 5/24

(Continued)

*Primary Examiner* — Anthony Nguyen
(74) *Attorney, Agent, or Firm* — Whitham, Curtis & Cook, P.C.

(57) ABSTRACT

The invention concerns a printing unit comprising a cylindrical bed (1), an anilox roller (3) for transferring ink to the rotating bed (1), and a counterpressure roller (2) which presses printed material (4) against the bed (1), the axes (11, 13) of the anilox roller (3) and of the bed (1) being tilted relative to one another.

8 Claims, 6 Drawing Sheets

(56) References Cited

U.S. PATENT DOCUMENTS

| | | | | |
|---|---|---|---|---|
| 2007/0151470 | A1* | 7/2007 | Rousseau | B41F 33/14<br>101/350.1 |
| 2010/0129620 | A1* | 5/2010 | Lopez-Mas | B41F 5/24<br>428/201 |
| 2011/0132216 | A1* | 6/2011 | Motard | B41F 13/28<br>101/248 |

FOREIGN PATENT DOCUMENTS

| | | | |
|---|---|---|---|
| WO | 2010/142405 | A2 | 12/2010 |
| WO | 2012/089496 | A1 | 7/2012 |

* cited by examiner

PRINTING UNIT

FIELD OF THE INVENTION

The invention relates to a printing unit having a roller-shaped printing form carrier, an inking roller for transferring ink to the rotating printing form carrier, and a counterpressure roller which presses a printed material against the printing form carrier. Such a printing unit is to be advantageously employed in the field of rotary printing presses in what is referred to as flexographic printing, other relief printing methods having non-flexible printing forms likewise being possible.

BACKGROUND

Where flexible printing forms are used, the term flexographic printing, in which low-viscosity inks are applied to the elastic printing plate material via an inking roller or an anilox roller, is used. Being a relief printing method, the raised areas of the printing form are image bearing, with the actively printing areas standing proud.

In printing presses, primarily flexographic printing presses, in which the printing units are constructed from at least three rotating cylinders, the printed image is uniformly created on the substrate to be printed, that is the printed material, in that in a first nip ink is transferred from an inking roller to the raised regions of a printing form bearing roller, the printing form carrier. In a second nip the ink is then transferred from these raised regions of the printing form carrier to the substrate. The substrate here is supported by a substrate-bearing roller, referred to as the counterpressure roller. The raised printing form here conjointly rotates with the substrate-bearing roller and enters and exits the first and second nip in a cyclical manner.

The printing form on the printing form carrier has a run-up edge and a run-off edge which constitute the beginning and the end of the motif to be printed, respectively. There is spacing between the run-up edge and the run-off edge, so as to achieve mutual separation of the printed motifs. As the inking roller rolls on the printing form of the printing form carrier and the counterpressure roller with the printed material rolls on the printing form carrier, vibrations are created when the run-up edge and/or the run-off edge come/comes into contact with the inking roller and the counterpressure roller. The pulses are inevitably created, since the inking roller has to roll on the printing form under a certain contact pressure so as to ensure a uniform inking process.

It is usual in the case of printing units of the prior art for the rotation axes of the roller pairs which are in each case in mutual contact to be disposed so as to be mutually parallel. The two axes of a roller pair here are in a common plane, wherein it is known for the rotation axes of a roller pair in the common plane to be set so as not to be mutually parallel, so as to adjust the respective nip between the rollers at one end to be different from the nip at the other end, the nip between the cylinders thus opening out or tapering off.

The transfer of ink in the first nip is performed while the inking roller is in contact with the raised areas of the printing form carrier. The transfer of ink in the second nip is performed while the inked and raised areas of the printing form carrier are in contact with the substrate which is supported by the substrate-bearing roller or counterpressure roller. On account of the contact forces between the individual rollers, which arise as a line load, said rollers are elastically deformed, on account of which the nip between the rollers at the clamping points is longer than in the center of the rollers.

As the raised regions of the printing form pass through the first nip and the second nip, the former are squeezed across the entire working width of the printing unit at least in part regions, so as to ensure that ink is transferred in a sufficient manner. The quantity of the ink being transferred inter alia depends on the prevailing squeezing forces. As a consequence of squeezing and rotating, rising and ebbing contact forces are created between the associated rollers. At a high rotating speed of the rollers and in the case of an unfavorable location of the raised regions of the printing form, the rising and ebbing of the contact forces is perceivable as an action of force or an internal impact load arising in a pulsed manner. There is a particularly unfavorable effect here that in practice printing forms which have an edge of the raised elements which runs parallel to the longitudinal extent of the rotation axes and which is printed as an image edge which runs transversely to the running direction of the substrate are often employed. These are the so-called run-up or run-off edges. There is furthermore a negative effect that in practice printing forms having raised regions often have a thickness profile across the working width of the press, so that in order for operational contact to be guaranteed the printing form or the printing plate has to be squeezed in such a manner that also those raised regions that have the lowest elevation still have operational contact. Consequently, the comparatively thick regions of the printing form are excessively squeezed, further increasing the contact forces arising within the nips.

Vibrations which are extraordinarily disturbing are created when a single run-up edge is present across the entire printing width of the printing form, that is to say in the case of a maximum press format, in other words when one or a plurality of printed images having a common run-up and run-off edge are located on the printing form carrier. Such vibrations are clearly displayed as lines in the printed image at considerably high machine speeds and/or at high printing contact pressure and, in particular, in the case of a long run-up edge or run-off edge which is parallel with the cylinder axis of the printing form carrier, and are counteracted by adapting the machine speed. Alternatives to reducing the machine speed include substituting another printing form material or using a shock-absorbing substructural material which is applied between the printing form carrier and the printing form. This substructural material in the form of an adhesive film with damping properties serves in fixing the printing form, that is the so-called printing plate, to the printing form carrier.

SUMMARY

It is an object of the present invention to provide a cost-effective printing unit by way of which high printing quality can be achieved at high machine speeds.

According to the invention this object is achieved by a printing unit having the features of the main claim. Advantageous design embodiments and refinements of the invention are listed in the dependent claims, the description, and the figures.

The printing unit according to the invention, having a roller-shaped printing form carrier, an inking roller for transferring ink to the rotating printing form carrier, and a counterpressure roller which presses a printed material against the printing form carrier provides that the axes of the inking roller and of the printing form carrier are not mutually parallel but, emanating from a common plane, are tilted in relation to one another. Instead of having an axially parallel arrangement of the axes of the inking roller and of the printing form carrier, an oblique positioning of the axes is used such that the run-up edge or run-off edge of the printing form does not abruptly encounter the inking roller, which in relation to the printing form carrier is mounted so as to provide a surface pressure, or run off therefrom across the entire length of the run-up edge as run-off edge, but that a run-up or run-off contact region, respectively, between the inking roller and the printing form carrier which are mutually orientable in parallel planes is established. On account thereof, the abrupt contact between the inking roller and the printing form across the entire width thereof is avoided, on account of which vibrations in the printing unit may be significantly reduced. The inking roller here, emanating from a common plane with the axis of the printing form carrier, is tilted in such a manner that the former bears on the printing form across the entire width of the latter, so as to ensure full application of the ink. The inking roller here, on account of the surface pressure of the inking roller, is in planar contact with the printing form. In the case of an axially parallel orientation, a substantially rectangular contact face would be established, and in the case of an obliquely set inking roller a hexagonal contour would be established if the inking roller were to be of the exact length of the printed image.

One refinement of the invention provides that the printing form carrier and the counterpressure roller are oriented so as to be mutually parallel, that is to say that the axes of the printing form carrier and of the counterpressure roller lie in a common plane and are oriented so as to be mutually parallel. The axes of the printing form carrier and of the counterpressure roller are thus axially parallel. The axis of the inking roller does not lie in the common plane of the axes of the printing form carrier and of the counterpressure roller but within the plane is advantageously tilted about a tilting axis, wherein the tiling axis is perpendicular to the axis of the printing form carrier within the common plane in which the axes of the counterpressure roller and of the printing form carrier are also disposed.

The axis of the inking roller and the axis of the printing form carrier are advantageously oriented in mutually parallel planes, such that the circumferential face of the inking roller may roll on the entire circumferential face of the printing form in order for the latter to be provided with ink.

Advantageously, a printing plate, that is to say a printing form, from an elastic material is applied to the printing form carrier, which in the case of a required surface pressure of the inking roller acting on the printing form carrier leads to elastic deformation of the printing plate. On account of this elastic deformation, there is no linear contact between the inking roller and the printing form carrier, but the circumference of the inking roller rather bears on the printing form in a planar manner. On account thereof, it is possible that complete wetting of the surface of the printing form with ink may take place despite the axes of the inking roller and the axis of the printing form carrier being tilted.

The inking roller and/or the counterpressure cylinder can be mounted in a common plane, so as to be displaceable in the direction of the printing form carrier and away from the printing form carrier, in order for the surface pressure to be able to be adjusted individually. In principle, it is also possible for the bearings of the inking roller and/or of the counterpressure cylinder to be individually readjustable in the direction of the printing form carrier, so as to be able to adjust an adapted surface pressure and to be able to perform adaptation to variations in shape or to deformations in the printing form, for example. By way of adjusting the spacing of the inking roller and/or of the counterpressure cylinder from the printing form it is possible for the respective contact faces on the printing form to be individually adjusted.

A run-up and/or run-off edge of the printing form may advantageously be oriented so as to be parallel with the rotation axis of the printing form carrier and/or with the rotation axis of the counterpressure roller, such that the printing motif commences and/or terminates perpendicularly to the conveying direction of the printed material. On account of the axially parallel arrangement of the counterpressure roller in relation to the printing form carrier, uniform printing pressure between the printed material and the printing form is ensured.

The tilting angle of the inking roller is preferably smaller than the angle which is established when proceeding from the point of intersection of the axes at the periphery of the inking roller up to the deformation limit of the printing form. On account thereof, it is ensured that the printing form is covered with ink across the entire area, since this avoids the oblique position becoming so pronounced that end regions of the printing form are not provided with an application of ink. Tilting out of the common plane only takes place up to an angle which still permits linear contact across the entire printing width of the printing form. The extent of tilting depends on the flexibility of the printing form and on the elasticity of the rollers, as well as on any potential camber of the latter.

The printing form may be fastened on the printing form carrier such that the maximum length of the printing form is determined by the circumference of the carrier cylinder. It is likewise possible for the printing form or the printing plate to be disposed on a belt or on another revolving carrier which, in a similar fashion to the system of the counterpressure cylinder along which the printed material runs, in the region of the ink uptake and of the ink discharge revolves around the printing form carrier.

BRIEF DESCRIPTION OF THE DRAWINGS

An exemplary embodiment of the invention will be explained in more detail in the following by means of the appended figures. In the figures.

DETAILED DESCRIPTION

Figure 1:
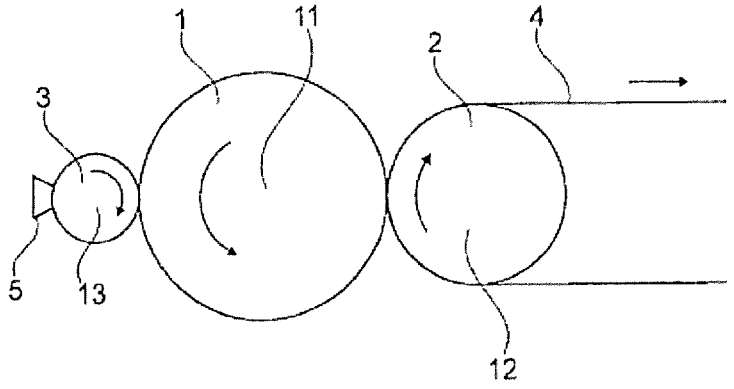
FIG. 1 shows a schematic illustration of a printing unit.

A schematic illustration of a printing unit having a roller-shaped printing form carrier 1 and a printing form (not illustrated in more detail) which is disposed on the outer circumference of the printing form carrier 1 is shown in FIG. 1. The printing form carrier 1 rotates about its axis 11. A counterpressure roller 2 which rotates about its axis 12 is disposed so as to be parallel with the axis 11 and with the printing form carrier 1. A printed material 4 which is pressed onto the surface of the printing form on the printing form carrier 1 revolves around the surface of the counterpressure roller 2. The counterpressure roller 2 and the printing form carrier 1 rotate in opposite directions such that the surfaces can roll on one another. The axis 12 of the counterpressure roller 2 is aligned so as to be axially parallel with the axis 11 of the printing form carrier 1 so that linear contact across the entire width of the printing form is established in the case of an ideally round and non-deformable design embodiment. The axes 11, 12 are in a common plane and therein are oriented so as to be mutually parallel.

An inking roller 3, which is assigned a chamber-type blade system 5 by way of which low-viscosity printing ink is initially applied to the surface of the inking roller 3, is disposed on that side of the printing form carrier 1 that lies opposite the counterpressure roller 2. The ink is transferred from the surface of the inking roller 3, which likewise rotates in the opposite direction to the rotation direction of the printing form carrier 1, onto the printing form. The inking roller 3 rotates about its rotation axis 13.

The printing form may be configured as an elastically deformable flexographic printing element which takes up ink and transfers the latter onto the printed material 4. The printing method which may be carried out by way of the printing unit illustrated is a relief printing method by way of rotary printing in which the flexible printing form may be composed of photopolymer or of rubber and in which the raised areas of the printing form are image bearing, that is to say that the inks which are located on the raised areas of the printing form are printed onto the printed material 4.

The quantity of supplied ink is regulated by way of the chamber-type blade system 5, and uniform application of ink across the entire length of the inking roller and thus also across the entire printing form is thus ensured. The ink is transferred in a rolling manner by the anilox roller 3 from the printing form onto the printed material 4.

Figure 2:
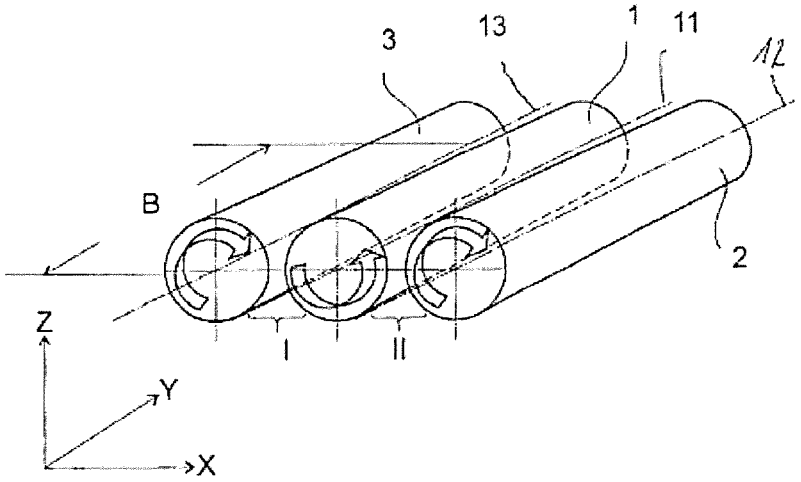
FIG. 2 shows a schematic illustration of a printing unit according to the prior art.

A schematic illustration of a roller arrangement of a flexographic printing press is shown in FIG. 2, the roller arrangement having the roller-shaped printing form carrier 1, the inking roller 3, and the counterpressure roller 2 or the substrate-bearing roller, the respective axes 11, 12, 13 of which are in a common plane. A first nip I is configured between the printing form carrier 1 and the inking roller 3, and a second gap II is configured between the printing form carrier 1 and the counterpressure roller 2. The rollers 1, 2, 3 have width B which is substantially identical, the spatial arrangement of the rollers 1, 2, 3 and of the roller axes 11, 12, 13 being indicated by the Cartesian coordinate system which is included in the drawing. The axes 11, 12, 13 of the rollers are in a common X-Y plane.

Figure 3:
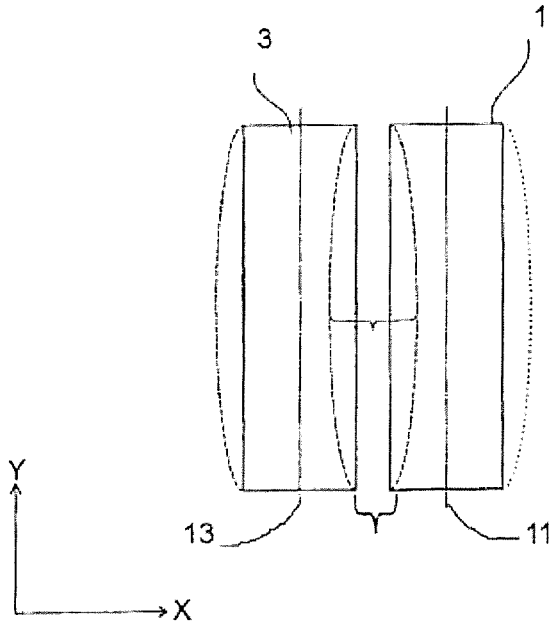
FIG. 3 shows a schematic illustration of flexing of a roller pair.

The deformation of the printing form carrier 1 and of the inking roller 3 during transfer of ink from the inking roller 3 to the printing form carrier 1 is schematically illustrated in a plan view in FIG. 3. On account of the required contact pressure of the inking roller 3 on the printing form, the rollers 1, 3 are deformed on account of the contact forces which arise as a line load, on account of which the first nip at the clamping points or outer mounting points of the rollers 1, 3 is smaller than between the mounting points or in the center of the rollers 1, 3, respectively. Elastic deformation in the X-Y plane thus takes place, at least in the case of the inking roller 1.

Figure 4:
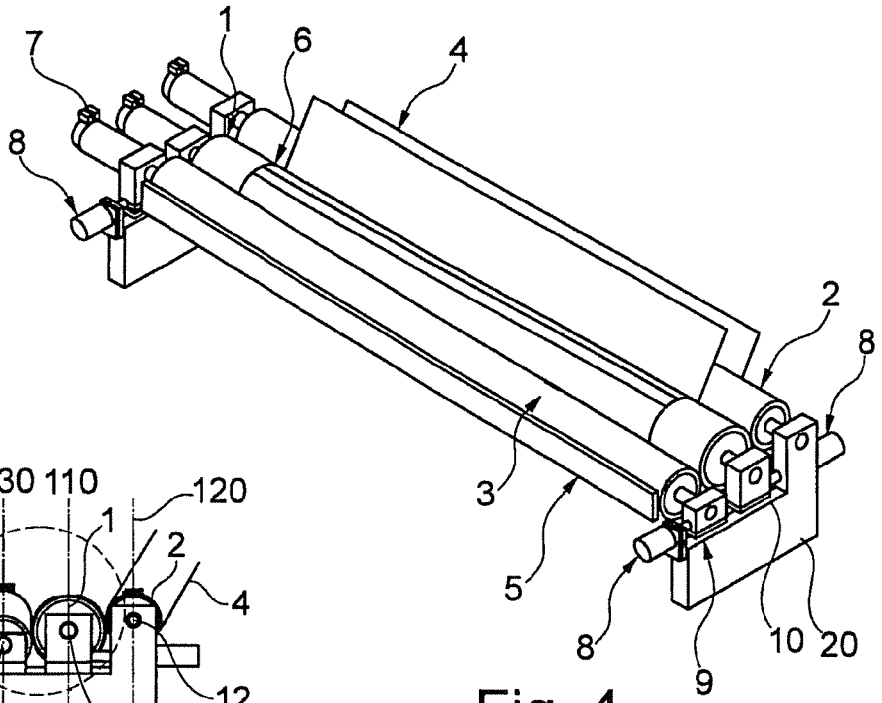
FIG. 4 shows a perspective view of a printing unit.

FIG. 4 shows a schematic and perspective illustration of a printing unit having the roller-shaped printing form carrier 1, the counterpressure roller 2, and the inking roller 3. The printing form 6 or the printing plate in the form of a flexographic printing element is attached to the printing form carrier 1. The counterpressure roller 2 is mounted in a locationally fixed manner in a machine frame 20, the printing form carrier 1 being mounted in a linear guide 9, so as to be displaceable on the machine frame 20 by way of a spindle 10 and a drive 8. The rotation axes of the printing form carrier 1 and of the counterpressure roller 2 are oriented so as to be axially parallel, that is to say that both rotation axes lie in a common plane in which the axes run so as to be mutually parallel. On account thereof, it is ensured that the printed material 4 is pressed onto the printing form 6 in a uniform and straight manner across the entire area, so as to achieve a printed image which is uniform and reproducible.

The inking roller 3 having the assigned chamber-type blade system 5 is likewise disposed on the machine frame 20, so as to be longitudinally displaceable in a linear guide 10. Actuator motors 8, which by way of spindles 10 enable readjustment along the linear guides 9, so as to enable an increase or a decrease of the surface pressure of the inking roller 3 on the printing form carrier 1 and on the printing form 6, are assigned to the mounting of the inking roller 3 at both ends. It can be seen as being indicated in FIG. 4 that the rearmost mounting point of the inking roller 3 is on a level which is different from the frontmost mounting point, such that the rotation axis of the inking roller 3 is oriented so as to be tilted in relation to the rotation axis of the printing form carrier 1. The rotation axes of the inking roller 3 of the printing form carrier 1 are not in a common plane, rather the inking roller 3 is tilted in a plane which lies parallel with a plane in which the axis of the printing form carrier 1 lies. On account thereof it is possible that as a result of the flexibility of the printing form 6 contact between the inking roller 3 and the printing form 6 which extends across the entire width of the printing form 6 is implemented, in order for uniform application of ink to be ensured. All rollers 1, 2, 3 are assigned drives 7 so as to ensure mutually corresponding rotation between them.

Figure 4A:
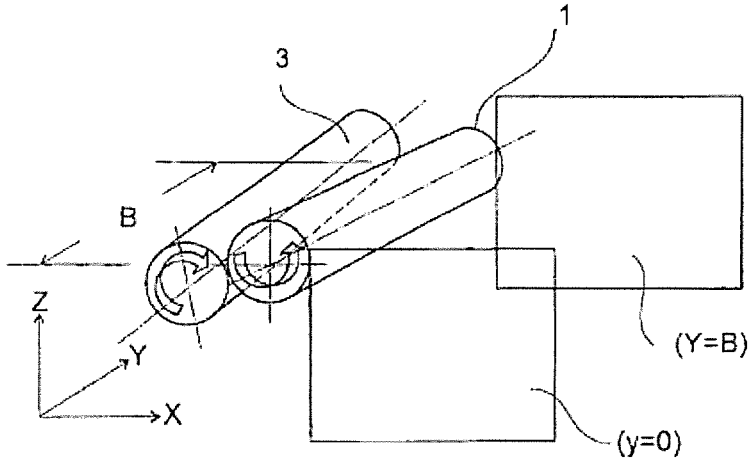
FIG. 4A shows a schematic illustration of a roller arrangement according to the invention.

The assignation of the inking roller 3 to the printing form carrier 1 in the tilted state is schematically illustrated in FIG. 4*a*. It can be seen that, emanating from a common plane, both rollers 1, 3 are tilted in relation to one another, tilting in the illustrated exemplary embodiment having taken place within mutually parallel Z-Y planes; in principle it is also possible that further oblique positioning and rotation about an axis which is parallel with the Z-axis additionally takes place, so as to be able to compensate for flexing, for example, and in order to achieve as uniform a linear contact as possible at minimum compression.

Figure 5:
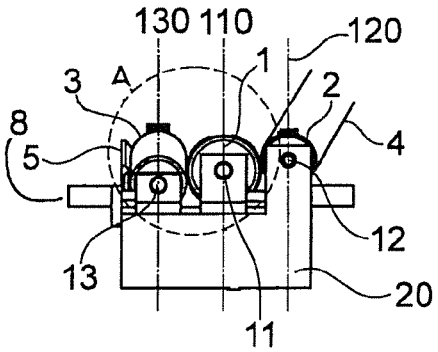
FIG. 5 shows a side view of FIG. 4.

The orientation of the inking roller 3 in relation to the printing form carrier 1 is shown in a side view in FIG. 5. It can be clearly seen that the rearmost bearing of the inking roller 3 in the image plane is positioned so as to be higher than the frontmost bearing, but that the axes 13, 11 of the inking roller 3 and of the printing form carrier 1 lie in parallel planes 130, 110 which are oriented so as to be perpendicular to the image plane. On account of the printing form carrier 1 and the counterpressure roller 2 being axially parallel, parallelism is also defined with the corresponding plane 120 which runs so as to be perpendicular to the image plane though the rotation axis 12 of the counterpressure cylinder.

Figure 6:
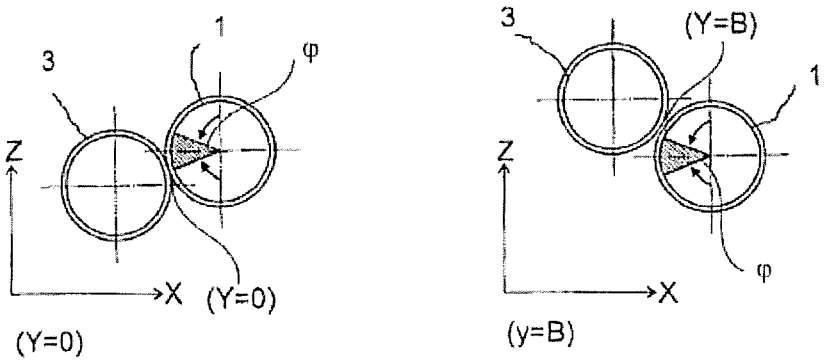
FIG. 6 shows sectional illustrations of mutually contacting rollers.

Sectional illustrations through the inking roller 3 and the printing form carrier 1 in the Y-Z plane are illustrated in FIG. 6, the left-hand illustration showing the contacting situation between the inking roller 3 and the printing form carrier 1 in the originating point of the X-Z plane, that is to say at the frontmost ends of the rollers, the right-hand illustration showing the contacting situation of the rollers at the rearmost end of the rollers, that is to say at Y=B. It can be seen in FIG. 6 that the contact points or contact areas of the rollers, on account of the tilting of the axes 11, 13, are at different elevations, that is to say at different Z-levels. As the cylindrical rollers 1, 3 roll on one another the shock which arises by the run-up edge impacting is effectively cushioned, since respective squeezing in the first nip happens at different points in time. As the printing form carrier 1 rolls on the inking roller 3 the raised material which is in the contact point B that is to say on the outward clamping side, is firstly squeezed, only then is squeezing gradually built up from the clamping side toward the opposite side.

Figure 7:
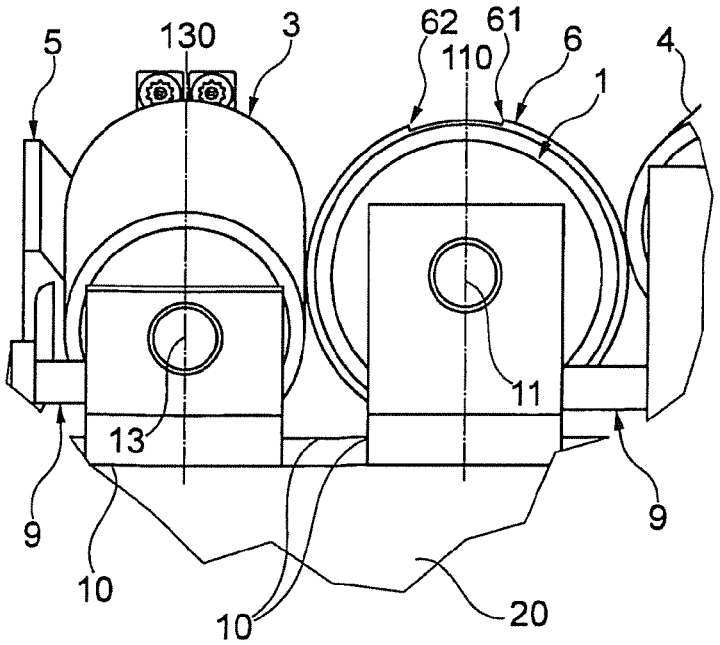
FIG. 7 shows an illustration of a detail of FIG. 5.

The orientation of the axes 11, 13 of the printing form carrier 1 and of the inking roller 3 is shown in an enlarged illustration in FIG. 7. The surfaces of the inking roller 3 and of the printing form carrier 1 run in a plane which is parallel with the planes 110, 130, since the axes 11, 13 also run in two mutually parallel planes, wherein however one axis is tilted in relation thereto. The printing form 6 in the form of a flexographic printing plate which has a run-up edge 61 and a run-off edge 62 is disposed on the printing form carrier 1. The run-up edge 61 and the run-off edge 62 are impact edges where the printed motif starts and ends, respectively. The run-up edge 61 and the run-off edge 62 run so as to be mutually parallel and so as to be parallel with the rotation axis 11, such that they abruptly come into contact with the printed material during the printing procedure. Oblique positioning, that is to say tilting within the plane 130, is provided in order for such a likewise abrupt contact with the inking roller 3 to be avoided.

Figure 8:
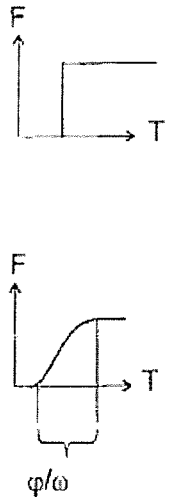
FIG. 8 shows force profiles.

The various force profiles are illustrated in FIG. 8, the upper illustration showing the force profile in the case of axes which are not tilted, that is to say in the case of mutually parallel axes which are oriented in one plane, the lower illustration providing the axial arrangement which is tilted, emanating from a common plane. It can be seen that in the case where the entire width of the run-up edge impacts simultaneously there is a shock, while there is a slow build-up of force in the case of a tilted axial orientation. Mutual tilting of the rotation axes 11, 13 emanating from a common plane has the effect that the cylinders 1, 3 which roll on one another must pass through the rotation angle $\phi$ before complete squeezing has been applied across the working width B or the machine. As a consequence thereof, rising and ebbing of the contact force F is decelerated, reducing both the shock as well as the vibrations in the rollers and the machine, this in turn reducing the defects in the printed image. In the primary effect of the cushioning of the shock, a further positive effect which likewise further reduces the printed effects is established on account of the inking roller 3 being tilted in relation to the printing form carrier 1 in the common plane. Tilting compensates for the non-uniform nip which is established as a consequence of squeezing and which is illustrated in FIG. 3. A nip which becomes narrower toward the center of the roller is superimposed onto the first nip which is widened on account of the flexing profiles which are established in the machine. As a consequence thereof, squeezing which is required between the inking roller 3 and the printing form carrier 1 is reduced, since the raised regions of the printing forms which have the lowest elevation now can also be contacted without the elastic regions of the printing form carrier 1 on the outer sides, that is to say at the mounting points, having to be excessively squeezed. The reduced contact force between the inking roller 3 and the printing form carrier reduces the shock which results during rolling and thus reduces all defects in the printed image which result therefrom.

The mounting of the inking roller 3, for adjusting the surface pressure, may be individually readjusted along the linear guide 10 by way of the drives 8 and the spindles 9. Likewise, the position of the printing form carrier 1 may be varied along the linear guide 10 by way of the spindles 9 and the drives 8, so as to adjust the contact pressure on the printed material 4. It is thus provided that the axis 13 of the inking roller 3 does not lie in a plane in which the axes 11, 12 of the printing form carrier 1 and of the counterpressure roller 2 lie, but that the former is oriented so as to be oblique thereto, such that the run-up edge 61 of the printing plate 6 is not parallel with the contact face to the inking roller 3. On account thereof, a temporally offset contact between the run-up edge 61 and the longitudinal extent of the inking roller 3 is implemented, the run-up edge 61 running along the inking roller 3 such that a pulse is reduced and undesirable vibrations as a result of the contact between the printing plate 6 and the inking roller 3 are not transferred by way of the printing form carrier or the machine frame 20 onto the contact point between the printing plate 6 and the printed material 4. On account thereof, the formation of lines in the printed motif is prevented.

Figure 9:
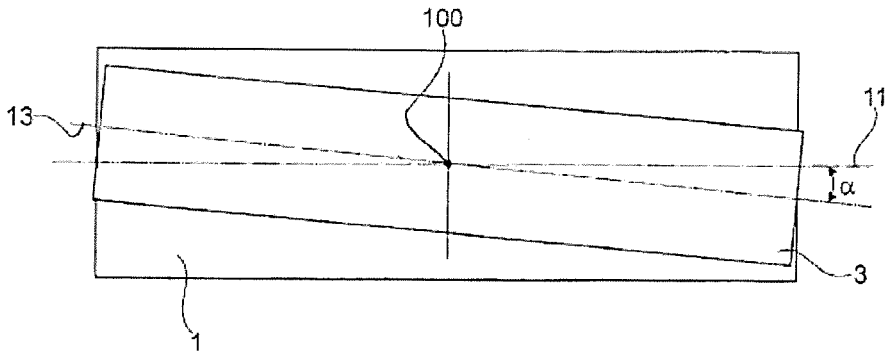
FIG. 9 shows an illustration of the contact face of an obliquely set inking roller on a printing form.

FIG. 9 shows the oblique positioning of the inking roller 3 in relation to the printing form carrier 1. The axes 13, 11 are mutually tilted at an angle $\alpha$. Tilting is performed about an axis 100 which is oriented so as to be perpendicular to the image plane. In the case of uniform lowering or raising, respectively, of the right-hand or left-hand mounting of the inking roller 3 in relation to the mounting of the printing form carrier 1, the central contact point is located in the center of both the inking roller 3 as well as of the printing form carrier 1. The position of the axis 100 or of the central contact point, respectively, may vary, depending on the positioning of the individual bearing points. The tilting angle $\alpha$ here is to be selected such that complete wetting of the printing form 6 with ink is ensured; in the exemplary embodiment illustrated the inking roller 3 and the printing form carrier 1 are of identical length, even a printing form 6 which is disposed across the entire length of the printing form carrier 1 being completely provided with ink. On account of the oblique positioning of the inking roller 3, a point of the run-up edge 61 which is located comparatively far outward would be the first to be in contact with the inking roller 3 and, depending on the rotation direction, would roll off from left to right or from right to left, respectively, such that a contact point travelling therealong instead of one abrupt contact across the entire area is established during one revolution of the printing form carrier 1. Complete coverage and wetting is achieved by way of the deformability of the printing form 6, such that a planar contact rather than what ideally is a linear contact is established between two rollers which roll on one another. Tilting about the axis 100 may take place within the contact area which is implemented in the case of a defined surface pressure by way of the inking roller 3 which is oriented so as to be axially parallel with the printing form carrier 1.

The invention claimed is:

1. A printing unit, comprising:

a roller-shaped printing form carrier;

an inking roller for transferring ink to the roller-shaped printing form carrier; and a counterpressure roller which presses a printed material against the roller-shaped printing form carrier, wherein the printing unit is configured such that an axis of the inking roller and an axis of the roller-shaped printing form carrier which emanate from a common plane are tilted in relation to one another during transfer of ink to the roller-shaped printing form carrier by the inking roller, wherein the roller-shaped printing form carrier and the counterpressure roller are oriented so as to be mutually parallel.

2. The printing unit as claimed in claim 1, wherein the axis of the inking roller and the axis of the roller-shaped printing form carrier are oriented in mutually parallel planes.

3. The printing unit as claimed in claim 1, wherein the roller-shaped printing form carrier has a printing plate formed from an elastic material.

4. The printing unit as claimed in claim 1, wherein the inking roller and/or the counterpressure roller are/is mounted in a common plane of the axes axis of the inking roller and the axis of the roller-shaped printing form carrier so as to be displaceable in a direction of the roller-shaped printing form carrier and a direction away from the roller-shaped printing form carrier.

5. The printing unit as claimed in claim 1, wherein a run-up and/or a run-off edge of a printing form are/is oriented so as to be parallel with a rotation axis of the roller-shaped printing form carrier and/or with a rotation axis of the counterpressure roller.

6. The printing unit as claimed in claim 1, wherein the inking roller includes bearings which are individually adjustable in the direction of the roller-shaped printing form carrier.

7. The printing unit as claimed in claim 1, wherein a tilting angle of the inking roller is smaller than an angle which is established when proceeding from a point of intersection of the axis of the inking roller and the axis of the roller-shaped printing form carrier at a periphery of the inking roller up to a deformation limit of a printing form.

8. The printing unit as claimed in claim 1, wherein the inking roller and the roller-shaped printing form carrier are rotatable through a defined rotation angle over which a complete squeezing of raised regions of a printing form is applied across a working width of the printing unit.

* * * * *